US007529505B2

(12) United States Patent
Okamoto

(10) Patent No.: US 7,529,505 B2
(45) Date of Patent: May 5, 2009

(54) RESTRICTING UNIT FOR RESTRICTING A SUPPORTER OF DEVELOPERS IN AN IMAGE FORMING APPARATUS

(75) Inventor: Tsugio Okamoto, Kani (JP)

(73) Assignee: Brother Kogyo Kabushiki Kaisha, Nagoya-shi, Aichi (JP)

( * ) Notice: Subject to any disclaimer, the term of this patent is extended or adjusted under 35 U.S.C. 154(b) by 255 days.

(21) Appl. No.: 11/376,333

(22) Filed: Mar. 16, 2006

(65) Prior Publication Data

US 2006/0210306 A1 Sep. 21, 2006

(30) Foreign Application Priority Data

Mar. 16, 2005 (JP) ..... 2005-075660

(51) Int. Cl.
*G03G 15/04* (2006.01)

(52) U.S. Cl. ..... 399/119

(58) Field of Classification Search ..... 399/107, 399/110–114, 119, 124
See application file for complete search history.

(56) References Cited

U.S. PATENT DOCUMENTS 6,647,228 B2 * 11/2003 Nakamura et al. ..... 399/124
6,708,011 B2 3/2004 Nomura et al.
2003/0053819 A1 * 3/2003 Nomura et al. ..... 399/110
2005/0047823 A1 * 3/2005 Nakashima et al. ..... 399/111
2006/0067734 A1 * 3/2006 Igarashi et al. ..... 399/119

FOREIGN PATENT DOCUMENTS

| | | | |
|---|---|---|---|
| JP | 4-119369 | A | 4/1992 |
| JP | 4-184361 | A | 7/1992 |
| JP | 5-257340 | A | 8/1993 |
| JP | 5-257340 | A | 10/1993 |
| JP | 10-161421 | A | 6/1998 |
| JP | 2003-015378 | | 1/2003 |
| JP | 2003-266865 | | 9/2003 |
| JP | 2003-266865 | A | 9/2003 |
| JP | 2004-258230 | | 9/2004 |

OTHER PUBLICATIONS

CN Office Action Feb. 15, 2008, CN App. 2006100681535.
JP Office Action dtd Sep. 11, 2008, JP App. 2005-075660 (partial translation).
EP Search Report, EP Appln. 06005305, dtd Jul. 13, 2006.

* cited by examiner

*Primary Examiner*—David M Gray
*Assistant Examiner*—Joseph S. Wong
(74) *Attorney, Agent, or Firm*—Banner & Witcoff, Ltd.

(57) ABSTRACT

An image forming apparatus comprises: a housing; a supporter located in the housing, a plurality of developing apparatus attachable to and detachable from the supporter; and a restricting unit that restricts movement of the supporter while at least one developing apparatus supported by the supporter is inside the housing. The supporter is movable relative to the housing.

18 Claims, 7 Drawing Sheets

RESTRICTING UNIT FOR RESTRICTING A SUPPORTER OF DEVELOPERS IN AN IMAGE FORMING APPARATUS

CROSS-REFERENCE TO RELATED APPLICATIONS

This application is based on and claims the benefit of priority from the prior Japanese Patent Application No. 2005-75660, filed on Mar. 16, 2005; the entire contents of which are incorporated herein by reference.

TECHNICAL FIELD

The present invention relates to an image forming apparatus of a laser printer or the like.

BACKGROUND

In a related art, there is known a color laser printer of a so-to-speak tandem type in which process cartridges in correspondence with toners of respective colors of yellow, magenta, cyan, black are arranged to align in a horizontal direction. Each process cartridge is provided with a photosensitive drum for carrying a toner image in each color to be placed onto a sheet, a developing apparatus including the toner in each color to be held on a surface of each photosensitive drum.

According to the color laser printer of the tandem type, for example, a belt supported by a plurality of rollers is arranged to be brought into contact with the photosensitive drum provided at each process cartridge from a lower side thereof. The sheet is carried to successively pass between the belt and each photosensitive drum by being guided on the belt. While carrying the sheet, the toner image carried by each photosensitive drum is transferred onto the sheet. Thereby, a multi-color image is formed on the sheet at a speed substantially the same as a speed of forming a monochromatic image.

Each photosensitive drum is irradiated with laser beam from an exposing apparatus based on image data, by selectively exposing a surface of the photosensitive drum which is previously charged, an electrostatic latent image in correspondence with the image data is formed, the toner is supplied to the surface of each photosensitive drum in correspondence with the electrostatic latent image, thereby, the toner image is carried by each photosensitive drum. There is an image forming apparatus including a plurality of exposing apparatus in correspondence with respective photosensitive drums for exposing corresponding photosensitive drums by the respective exposing apparatus (for example, refer to JP-A-2003-266865).

According to the image forming apparatus disclosed in JP-A-2003-266865, the plurality of exposing apparatus in correspondence with the respective photosensitive drums are supported by a single base slidably attached to a main body frame of the color laser printer. The base is movable between a state inside of the main body frame and a state of being moved from the main body frame in a horizontal direction while the base is still supported by the main body frame.

When an operation of replacement of the exposing apparatus or an operation of checking a light source or an optical part provided to the respective exposing apparatus is carried out, by moving the base from the main body frame, all of the exposing apparatus are brought into a state outside the main body frame. The respective exposing apparatus may be detached from the base.

SUMMARY

However, according to the apparatus described in JP-A-2003-266865, in the state of moving the base from the main body frame, all of the plurality of exposing apparatus supported by the base are outside of the main body frame. Therefore, a gravitational center of the image forming apparatus shifts significantly in the horizontal direction and there may exist a concern of inclining or toppling the image forming apparatus.

There is a color laser printer of a tandem type in which respective process cartridges are supported by a single base provided slidably to a main body frame. In such a color laser printer, even when developing apparatus provided to respective process cartridges are detached from the base for replacement, a drawback similar to the above-described is brought about.

It is an object of one aspect of the invention to provide an image forming apparatus which is difficult to be inclined or toppled.

According to an aspect of the invention, an image forming apparatus includes: a plurality of developing apparatus attachable and detachable to and from inside of a housing of the image forming apparatus; a supporter movable to and from the housing between a state of being included at inside of the housing and a state of being exposed from inside of the housing; and a restricting unit restricting the supporter from being moved in a state in which at least one developing apparatus supported by the supporter is disposed at inside of the housing.

According to another aspect of the invention, an image forming apparatus includes: a plurality of developing apparatus being attachable and detachable to and from inside of a housing; a supporter provided to the housing. The supporter supports the plurality of developing apparatus. The supporter is movable between a state of being included at inside of the housing and a state of being exposed from inside of the housing. A side face of the housing is formed with a front face opening for passing the supporter moved from inside of the housing to a side of being exposed. An upper face of the housing is formed with an upper face opening to be continuous to the front face opening. A cover opens and closes the front face opening and the upper face opening. In a state of opening the cover, at least one developing apparatus of the plurality of developing apparatus is attachable and detachable thereto and therefrom by passing the upper face opening even in a state of including the supporter at inside of the housing.

BRIEF DESCRIPTION OF THE DRAWINGS

These and other objects and advantages of the following described illustrative aspects of the invention will become more fully apparent from the following detailed description taken with the accompanying drawings in which:

FIG. 7A is a view viewing the supporter from an upper front side on one side in a width direction, FIG. 7B shows a view viewing the supporter from an upper front side on other side in the width direction.

DESCRIPTION OF ILLUSTRATIVE ASPECTS

<Total Constitution of Color Laser Printer>

Figure 1:
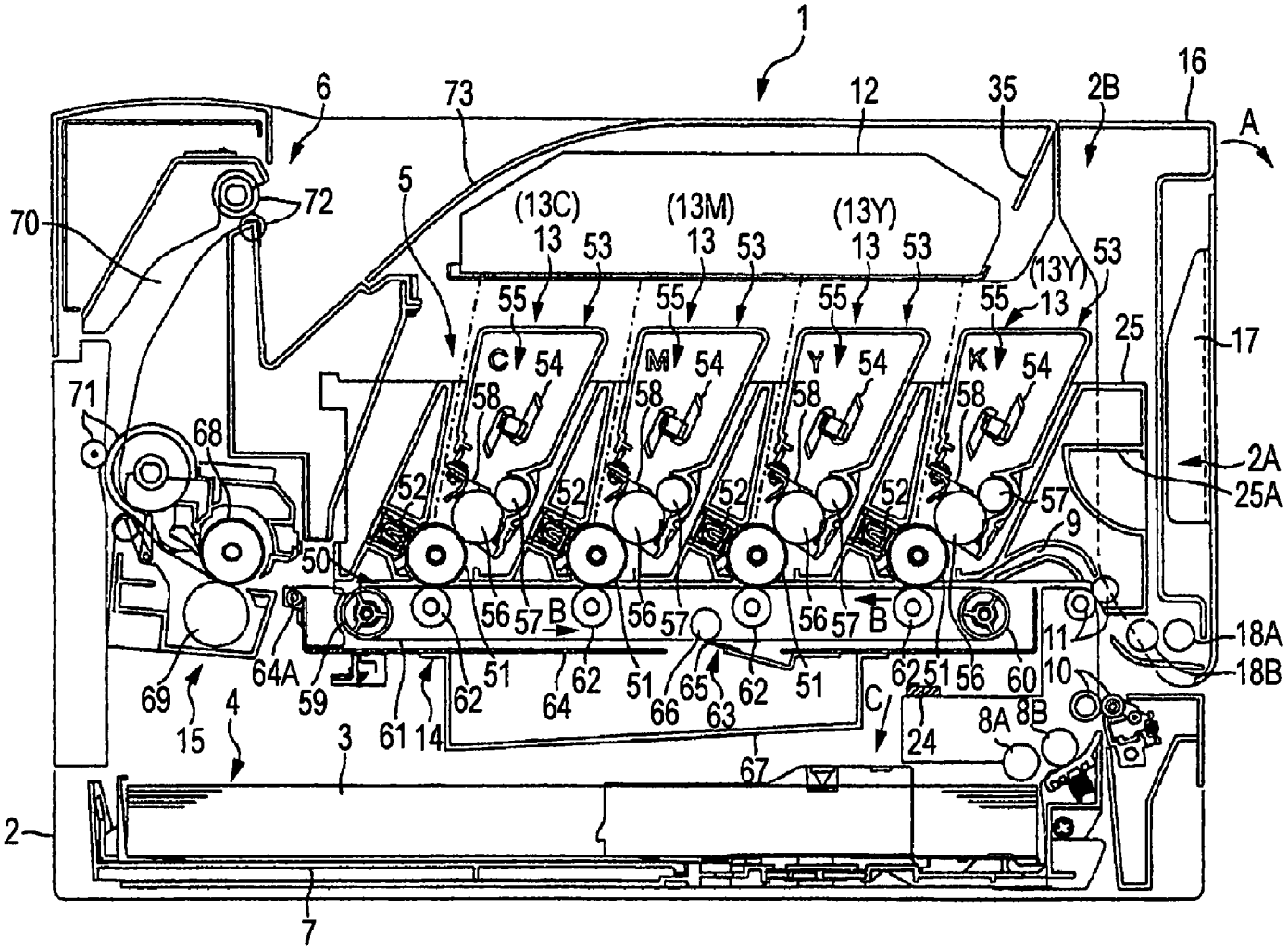
FIG. 1 is a side sectional view showing an illustrative aspect of a color laser printer as an image forming apparatus showing a state of closing an cover.
Figure 2:
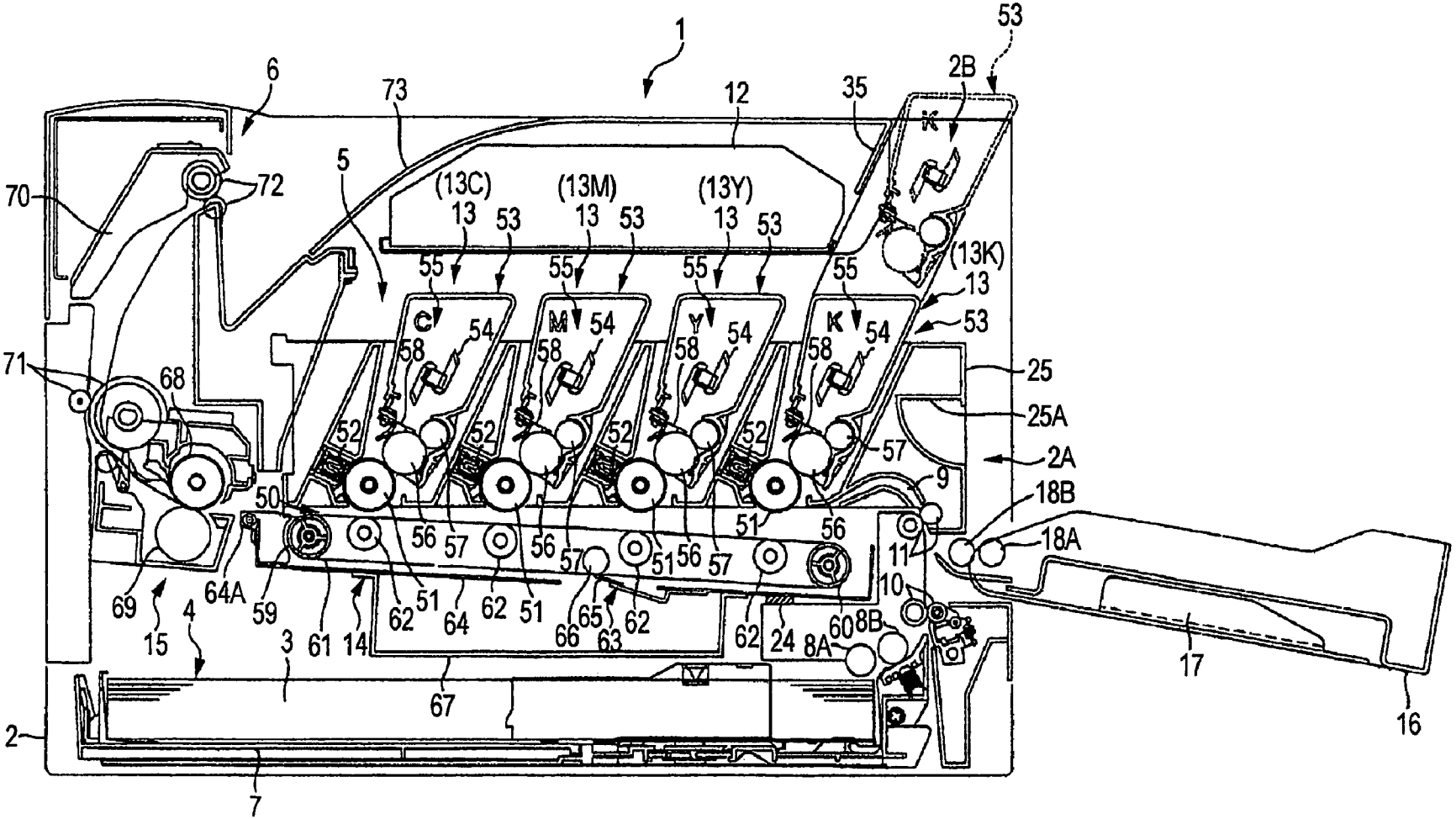
FIG. 2 is a side sectional view showing a state of opening the cover of the color laser printer including a supporter inside a housing.

FIG. 1 is a side sectional view showing an illustrative aspect of a color laser printer according to an image forming apparatus showing a state of closing a cover 16. FIG. 2 is a side sectional view showing a state of opening the cover 16 of the color laser printer 1 showing a state of including a supporter 25 at inside of a housing 2.

A color laser printer of a tandem type of a horizontally aligning type is provided in which process portions 13 are arranged in alignment in a horizontal direction. The color laser printer 1 includes a sheet feeding portion 4 for feeding sheet 3 as a record medium, an image forming portion 5 for forming an image on the fed sheet 3, and a sheet discharging portion 6 for discharging the sheet 3 formed with the image at inside of the housing 2 substantially in a shape of a hollow parallelepiped.

<Constitution of Sheet Feeding Portion>

In the follow explanation, a right side of FIG. 1 is defined as a front side and a left side is defined as a rear side.

The sheet feeding portion 4 includes a sheet cassette 7 provided at a bottom portion in the housing 2, a pickup roller 8A and a sheet feeding roller 8B provided at an upper front side of the sheet cassette 7, a sheet feeding path 9 provided on an upper front side of the sheet feeding roller 8B, a pair of carrying rollers 10 and a pair of registration rollers 11 provided in the midst of the sheet feeding path 9.

The sheet cassette 7 is attachable to and detachable from the housing 2 in a front-rear direction. The sheets 3 may be stacked in the sheet cassette 7 when the sheet cassette 7 is moved from the housing 2. Further, when the sheet cassette 7 is mounted to the housing 2, a topmost sheet 3 stacked inside the sheet cassette 7 is first picked up by the pickup roller 8A, carried frontward, successively, fed to the sheet feeding path 9 by the sheet feeding roller 8B.

The sheet feeding path 9 is formed as a path of carrying the sheet 3 substantially in a U-like shape. An upstream side end portion of the sheet feeding path 9 is contiguous to the sheet feeding roller 8B on a lower side. As such, the sheet 3 is fed frontward. A downstream side end portion of the sheet feeding path 9 is contiguous to a carrying belt 61, mentioned later, on an upper side. As such, the sheet 3 is fed rearward.

Further, the sheet 3 fed to the sheet feeding path 9 is carried by the carrying rollers 10 in the sheet feeding path 9, registered by the registration rollers 11 after reversing the carrying direction on front and rear sides thereof, thereafter, fed rearward by the registration rollers 11.

A front face of the housing 2 is formed with a front face opening 2A for communicating inside and outside of the housing 2 in the front-rear direction. Further, a front end portion of an upper face of the housing 2 is formed with an upper face opening 2B for communicating inside and outside of the housing 2 in an up-down direction. The housing 2 is provided with the cover 16 capable of simultaneously opening/closing the front face opening 2A and the upper face opening 2B. The cover 16 is pivotably provided to the housing 2 by way of a pivoting shaft 16A (refer to FIG. 3), mentioned later.

The cover 16 is provided as a multipurpose tray which is pivoted in a direction indicated by an arrow mark A of FIG. 1, which is a clockwise direction in the FIG. 1. When the front face opening 2A and the upper face opening 2B are opened as shown by FIG. 2, an inner face of the housing 2 is directed upward so that the sheets 3 can be stacked on the inner face. The cover 16 is provided with a sheet guide 17 for guiding the stacked sheets 3 along the front-rear direction.

A lower portion of the front face opening 2A of the housing 2 is provided with a second pickup roller 18A and a second sheet feeding roller 18B for feeding the sheets 3 stacked on the inner face of the cover 16. A topmost sheet 3 stacked on the inner face of the cover 16 is first picked up by the second pickup roller 18A, carried rearward, successively fed to the sheet feeding path 9 by the second sheet feeding roller 18B. The sheet 3 fed to the sheet feeding path 9 is registered by the registration roller 11 in the sheet feeding path 9, thereafter, fed rearward by the registration roller 11.

<Constitution of Image Forming Portion>

The image forming portion 5 includes a scanner unit 12, the process portion 13, a transferring portion 14 and a fixing portion 15.

<Constitution of Scanner Unit>

The scanner unit 12 is arranged above the process portion 13 at an upper portion in the housing 2. The scanner unit 12 is provided with a laser beam emitting portion, a polygon mirror, a lens and a reflecting mirror (all of which are not illustrated), laser beam based on image data emitted from the laser beam emitting portion is reflected by the polygon mirror, passes through the lens, reflected by the reflecting mirror, and is irradiated on a photosensitive drum 51 as the image carrier, mentioned later.

<Constitution of Process Portion>

As shown by FIG. 1, the process portions 13 are provided in correspondence with toner colors. That is, the process portions 13 comprise a cyan process portion 13C, a magenta process portion 13M, a yellow process portion 13Y and a black process portion 13K. The process portions 13C, 13M, 13Y, 13K are successively arranged to align from rearward to frontward to overlap in the horizontal direction to be spaced apart by intervals thereamong in this order. Further, more than four of the toner colors may be provided and in that case, the number of the process portions 13 may be the same as a number of the toner colors.

Each process portion 13 is provided with the photosensitive drum 51, a scorotron type charger 52 and the developing cartridge 53 as the developing apparatus.

Each process portion 13 is supported by a supporter 25 movably provided in a front-rear direction (first direction) relative to the housing 2. Each of the photosensitive drums 51 and each of the scorotron type chargers 52 provided to each of the respective process portions 13 are fixed by the supporter 25. The developing cartridge 53 is provided attachably to and detachably from the supporter 25 so that the developing cartridge 53 can be detached from the supporter 25 by being moved to a skewed upper front side and can be attached to the supporter 25 by being moved from a skewed lower rear side.

An upper face of each developing cartridge 53 is formed with a developing cartridge grabbing portion 53A (refer to FIG. 7) which a user may grab. By grabbing a developing cartridge grabbing portion 53A, the developing cartridge 53 may be attached to or detached from the supporter 25.

A rear end edge of the upper face opening 2B of the housing 2 is formed with a guide portion 35 extending in a skewed lower rear side toward inside of the housing 2. The guide portion 35 extends along a direction of attachment and detachment of the developing cartridge 53 (refer to the developing cartridges 53 indicated by a broken line of FIG. 2). Thus the developing cartridge 53 is guided by the guide portion 35 when the developing cartridge 35 is attached to and detached from the supporter 25.

A front face of the supporter 25 is formed with a front grabbing portion 25A which a user may grab. By grabbing the front grabbing portion 25A, the supporter 25 may be moved to the front side in the horizontal direction from inside of the housing 2 to outside of the housing 2.

The photosensitive drum 51 includes a drum body in a cylindrical shape and a drum shaft extended in an axial direction of the drum body at an axis center of the drum body. A topmost layer of the drum body is formed by a positively chargeable photosensitive layer comprising polycarbonate.

The drum body is provided rotatably relative to the drum shaft. The drum shaft is unrotatably supported by both side walls in a width direction of the process portion 13. The width direction is defined as orthogonal to the front-rear direction and the up-down direction. Further, the photosensitive drum 51 is driven to rotate in a direction the same as a direction of moving a carrying belt 61, that is, a clockwise direction shown in the drawing at a position of being brought into contact with the carrying belt 61, mentioned later.

The scorotron type charger 52 is a positive-charge type scorotron charger including a wire and a grid for generating corona discharge by applying charge bias to the wire. The scorotron type charger 52 is arranged oppositely to the photosensitive drum 51 to be spaced apart by an interval therebetween so as not to contact the photosensitive drum 51 on a rear side of the photosensitive drum 51.

The developing cartridge 53 includes an agitator 54, a developing roller 56, a supply roller 57 and a layer thickness restricting blade 58.

An upper side portion of a cabinet of the developing cartridge 53 is formed as a toner chamber 55 for accommodating a toner in each color. That is, the toner chamber 55 of the cyan process portion 13C accommodates positively chargeable nonmagnetic single component polymerized toner in cyan. The toner chamber 55 of the magenta process portion 13M accommodates positively chargeable nonmagnetic single component polymerized toner in magenta. The toner chamber 55 of the yellow process portion 13Y accommodates positively chargeable nonmagnetic single component polymerized toner in yellow. The toner chamber 55 of the black process portion 13K accommodates positively chargeable nonmagnetic single component polymerized toner in black.

Further specifically, the toner in each color may be substantially spherical polymerized toner obtained in a polymerizing method. One of major components of the polymerized toner is constituted by a binding resin provided by copolymerizing styrene species monomer of styrene, or acrylic specie monomer of acrylic acid, alkyl(C1 through C4)acrylate, alkyl(C1 through C4)metaacrylate by a known polymerizing method of suspension polymerization. A toner base particle is formed by blending a colorant, a charge control agent, wax to the binding resin. The polymerized toner is formed by adding to the toner base particlean additive to promote fluidity of the polymerized toner.

As the colorant, respective colorants of cyan, magenta, yellow and black are blended. Further, as the charge control agent, there is blended a charge control resin provided by copolymerizing a monomer capable of being copolymerized with an ionic monomer having ionic functioning group of ammonium salt, styrene species monomer, acrylic species monomer. Further, as the additive, there is blended an inorganic power of a power of a metal oxide of, for example, silica, aluminum oxide, titanium oxide, strontium titanate, cerium oxide, magnesium oxide, a powder of carbide, a powder of metal salt.

Further, the toner in each color is not limited to the nonmagnetic single component polymerized toner but may be, for example, a crushed toner.

The agitator 54 is rotatably arranged inside the toner chamber 55 about a rotating shaft extended in the width direction. Due to rotation of the agitator 54, the toner inside the toner chamber 55 may be agitated.

The developing roller 56 is arranged oppositely to the photosensitive drum 51 on a front upper side of the photosensitive drum 51 and is brought into press contact with the photosensitive drum 51. The developing roller 56 includes a roller shaft made of a metal which is covered with a roller portion comprising an elastic member made of a conductive rubber material. Further specifically, the roller portion is formed by a two layers structure of a roller layer and a coating layer.

The roller layer is made of a conductive elastic material including carbon small particles. The elastic material may be urethane rubber, silicone rubber, EPDM rubber. The coating layer is covered on a surface of the roller layer and may be made of urethane rubber, urethane resin, polyimide resin.

Further, the roller shaft of the developing roller 56 is rotatably supported by the both side walls in the width direction of the process portion 13 and is configured to be applied with developing bias when forming an image.

The supply roller 57 is arranged oppositely to the developing roller 56 on a front upper side of the developing roller 56 and is brought into press contact with the developing roller 56. The supply roller 57 includes a roller shaft made of a metal which is covered with a roller portion made of a conductive sponge member. Further, the roller shaft of the supply roller 57 is rotatably supported by the both side walls in the width direction of the process portion 53.

The layer thickness restricting blade 58 comprises a leaf spring member of a metal and a pressing member having a section in a semicircular shape made of insulating silicone rubber at a front end portion of the leaf spring member. Further, the layer thickness restricting blade 58 is supported by the cabinet of the developing cartridge 53 on an upper side of the developing roller 56 so that the pressing member is brought into press contact with the developing roller 56 from an upper side.

At the respective process portions 13, when forming an image, the toner in each color included in the respective toner containing chambers 55 is supplied to the supply rollers 57 and supplied to the developing rollers 56 by rotation of the supply rollers 57. At this occasion, the toners are positively charged by friction between the supply rollers 57 and the developing rollers 56. The toners supplied onto the developing rollers 56 advance between the layer thickness restricting blades 58 and the developing rollers 56 to constitute thin layers having constant thicknesses and carried on the developing rollers 56.

On the other hand, the scorotron type charger 52 generates corona discharge by the applied charge bias. The surface of the photosensitive drum 51 is positively charged uniformly by the scorotron type charger 52 in accordance with rotation of the photosensitive drum 51. Thereafter, as shown by a one-dotted chain line in FIG. 1, the surface of the photosensitive drum 51 is selectively exposed by the laser beam emitted from the scanner unit 12 to each photosensitive drum 51 so as to form electrostatic latent image in each color in correspondence with an image to be formed on the sheet 3.

While the photosensitive drum 51 further rotates, when the positive-charged toner carried on the surface of the developing roller 56 is oppositely brought into contact with the photosensitive drum 51 by rotation of the developing roller 56, the toner is supplied to the electrostatic latent image formed on the surface of the photosensitive drum 51.

Thereby, the electrostatic latent image of the photosensitive drum 51 is visualized in correspondence with each color.

<Constitution of Transfer Portion>

The transfer portion 14 is arranged along the front-rear direction above the sheet cassette 7 and below the process portion 13 inside of the housing 2. The transfer portion 14 includes a drive roller 59, a driven roller 60, the carrying belt 61, a transfer roller 62, a belt cleaning portion 63, and a support member 64 for supporting all elements of the transfer portion 14.

The drive roller 59 is arranged on a rear lower side of the photosensitive drum 51 of the cyan process portion 13C. The drive roller 59 is driven to rotate in a direction reverse to the direction of rotation of the photosensitive drum 51, which is counterclockwise direction in the drawing, when forming the image.

The driven roller 60 is arranged on a front lower side of the photosensitive drum 51 of the black process portion 13K to be opposed to the drive roller 59 in the front-rear direction. The driven roller 60 is driven to rotate in a direction the same as the direction of rotation of the drive roller 59, which is counterclockwise direction in the drawing, when the drive roller 59 rotates.

The carrying belt 61 is made of an endless belt and formed from resin of polycarbonate or polyimide dispersed with conductive particles of carbon. The carrying belt 61 is wound between the drive roller 59 and the driven roller 60 and is arranged such that an outer surface of the wound carrying belt 61 is oppositely brought into contact with all of the photosensitive drums 51 of the respective process portions 13. A carrying path 50 is formed between the photosensitive drums 51 of the respective process portions 13 and the carrying belt 61. The sheet 3 may be carried along the carrying path 50 from the front side to the rear side Further, by driving the drive roller 59, the driven roller 60 is driven. The carrying belt 61 moves in a direction indicated by an arrow mark B (counterclockwise direction in the drawing) and circulates between the drive roller 59 and the driven roller 60. The carrying belt 61 moves in a reverse direction of the direction in which the photosensitive drum 51 moves at a contact position of the carrying belt 61 and the photosensitive drum 51.

The transfer rollers 62 are arranged inside the carrying belt 61 between the drive roller 59 and the driven roller 60. Each transfer roller 62 is oppositely provided to the photosensitive drums 51 of the respective process portions 13 so that the transfer roller 62 and the photosensitive drum 51 sandwich the carrying belt 61. Each transfer roller 62 includes a roller shaft made of a metal which is covered with roller portion comprising an elastic member made of conductive rubber material.

Further, the roller shaft of the transfer roller 62 extends along the width direction, and is rotatably supported by the supporter 25. Transfer bias may be applied to the roller shaft. The transfer rollers 62 rotates in a direction the same as a direction of movement of the carrying belt 61 at a contact position of the transfer rollers 62 and the carrying belt 61.

The sheet 3 fed from the sheet feeding portion 4 is carried from the front side to the rear side on the carrying path 50 by the carrying belt 61 circulated by the drive roller 59 and the driven roller 60. The sheet 3 successively passes image forming positions between the carrying belt 61 and the photosensitive drums 51 of the respective process portions 13. Further, toner images in correspondence with the respective colors carried by the photosensitive drums 51 of the respective process portions 13 are successively transferred onto the sheet 3. As such, the multi-color image is formed on the sheet 3.

In detail, first the toner image in black carried on the photosensitive drum 51 of the black process portion 13K is transferred onto the sheet 3, then successively, the toner image in yellow carried on the photosensitive drum 51 of the yellow process portion 13Y is overlappingly transferred onto the sheet 3 which has already had the toner image in black. Further in similar operation, the toner image of magenta carried on the photosensitive drum 51 of the magenta process portion 13M, the toner image of cyan carried on the photosensitive drum 51 of the cyan process portion 13C are successively overlapped on the sheet 3. As such, the multi-color image is formed on the sheet 3.

The color laser printer 1 is the tandem type apparatus provided with a plurality of the process portions 13 in correspondence with the respective colors at the respective process portions 13. Therefore, the multi-color image can be formed at a speed substantially the same as a speed of forming a monochromatic image.

The belt cleaning portion 63 is arranged below the carrying belt 61. The belt cleaning portion 63 includes a cleaning blade 65 arranged to contact the outer surface of the carrying belt 61 and a cleaning box 67 provided below the cleaning blade 65. The cleaning blade 65 is configured to scrape off paper powder or toner adhered to the outer surface of the carrying belt 61. The cleaning blade 65 is fixed to the support member 64 at a base end portion of the cleaning blade 65. The base end portion of the cleaning blade 65 extends in a skewed upper side toward the rear side. A front end portion of the cleaning blade 65 is brought into contact with the outer surface of the carrying belt 61. Inside a loop of the carrying belt 61 is arranged a tension roller 66 rotatably supported by the support member 64. A roller shaft of the tension roller 66 extends in the width direction such that the tension roller 66 and the cleaning blade 65 sandwich the carrying belt 61.

While the carrying belt 61 moves, the front end portion of the cleaning blade 65 is brought into sliding contact with the outer surface of the carrying belt 61 so as to scrape off paper powder and/or toner adhered to the outer surface of the carrying belt 61. Paper powder and toner scraped off by the cleaning blade 65 are stored in the cleaning box 67 attached to the support member 64.

The support member 64 is arranged to be pivotable about a pivoting shaft 64A extending in the width direction at a rear end portion of the support member 64. When the cover 16 is closed as shown in FIG. 1, the outer surface of the carrying belt 61 contacts with all of the photosensitive drums 51 of the process portions 13. When the cover 16 is pivoted to open the front face opening 2A and the upper face opening 2B as shown in FIG. 2, the support member 64 is pivoted in a direction indicated by an arrow mark C in FIG. 1, which is clockwise direction in the drawing, about the pivoting shaft 64A. Thereby, the carrying belt 61 is displaced in a direction of separating from the photosensitive drums 51.

<Constitution of Fixing Portion>

The fixing portion 15 is arranged on a rear side of the transfer portion 14. The fixing portion 15 includes a heating roller 68 and a pressing roller 69. The heating roller 68 comprises a metal base tube formed with a die removing layer at a surface thereof and inwardly mounted with a halogen lamp along an axial direction thereof. Further, a surface of the heating roller 68 is heated to a fixing temperature by the halogen lamp. Further, the pressing roller 69 is provided oppositely to the heating roller 68 from a lower side thereof to press the heating roller 68.

Further, the sheet 3 formed with the multi-color image transferred thereon is successively carried to the fixing portion 15. The multi-color image is thermally fixed to the sheet 3 by being heated and pressed while the sheet 3 passes between the heating roller 68 and the pressing roller 69.

<Constitution of Sheet Discharge Portion>

The sheet discharge portion 6 includes a sheet discharge path 70, a carrying roller 71, a sheet discharge roller 72 and a sheet discharge tray 73.

The sheet discharge path 70 is formed substantially in a U-like shape. An upstream end portion of the sheet discharge path 70 is contiguous to the fixing portion 15 on a lower side such that the sheet 3 is fed toward the rear side. A downstream end portion of the sheet discharge path 70 is contiguous to the sheet discharge roller 72 on an upper side such that the sheet 3 is discharged toward the front side.

The carrying roller 71 is provided as a pair of rollers at a middle of the sheet discharge path 70.

The sheet discharge roller 72 is provided as a pair of rollers at the downstream end portion of the sheet discharge path 70.

The sheet discharge tray 73 is formed as an inclined wall inclined downward from the front side to the rear side at an upper face of the housing 2.

Further, the sheet 3 fed from the fixing portion 15 to the sheet discharge path 70 is carried to the sheet discharge roller 72 by the carrying roller 71. The carrying direction of the sheet 3 is reversed during the sheet 3 is carried on the sheet discharge path 70. Thereafter, the sheet 3 is discharged toward the front side by the sheet discharge roller 72. The discharged sheet 3 is mounted above the sheet discharge tray 73.

<Explanation of Cooperation of Cover and Support Member>

Figure 3:
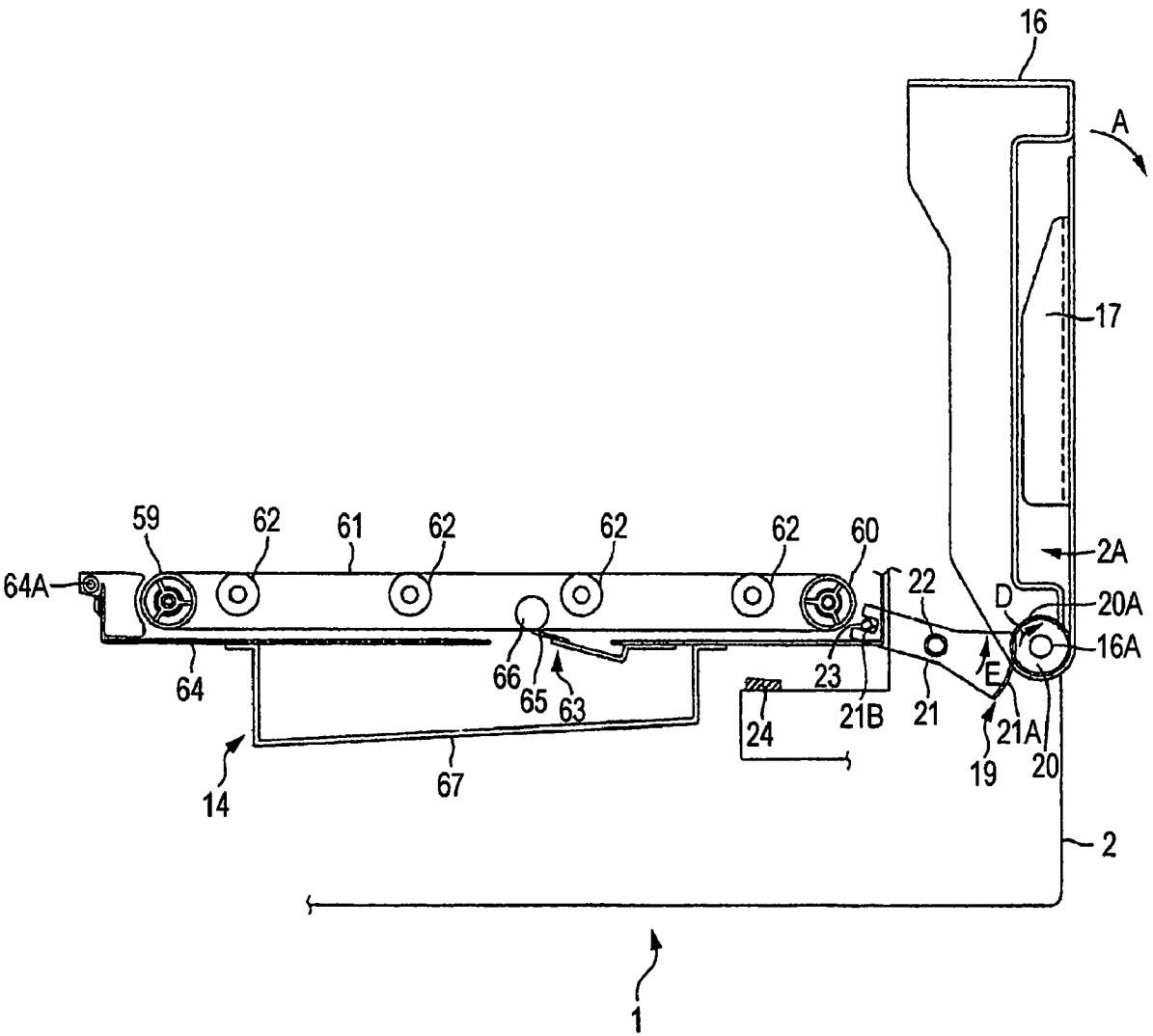
FIG. 3 is a partially sectional side view of the color laser printer showing a constitution of a mechanism of cooperatively moving the cover and the support member showing a state of closing the cover.
Figure 4:
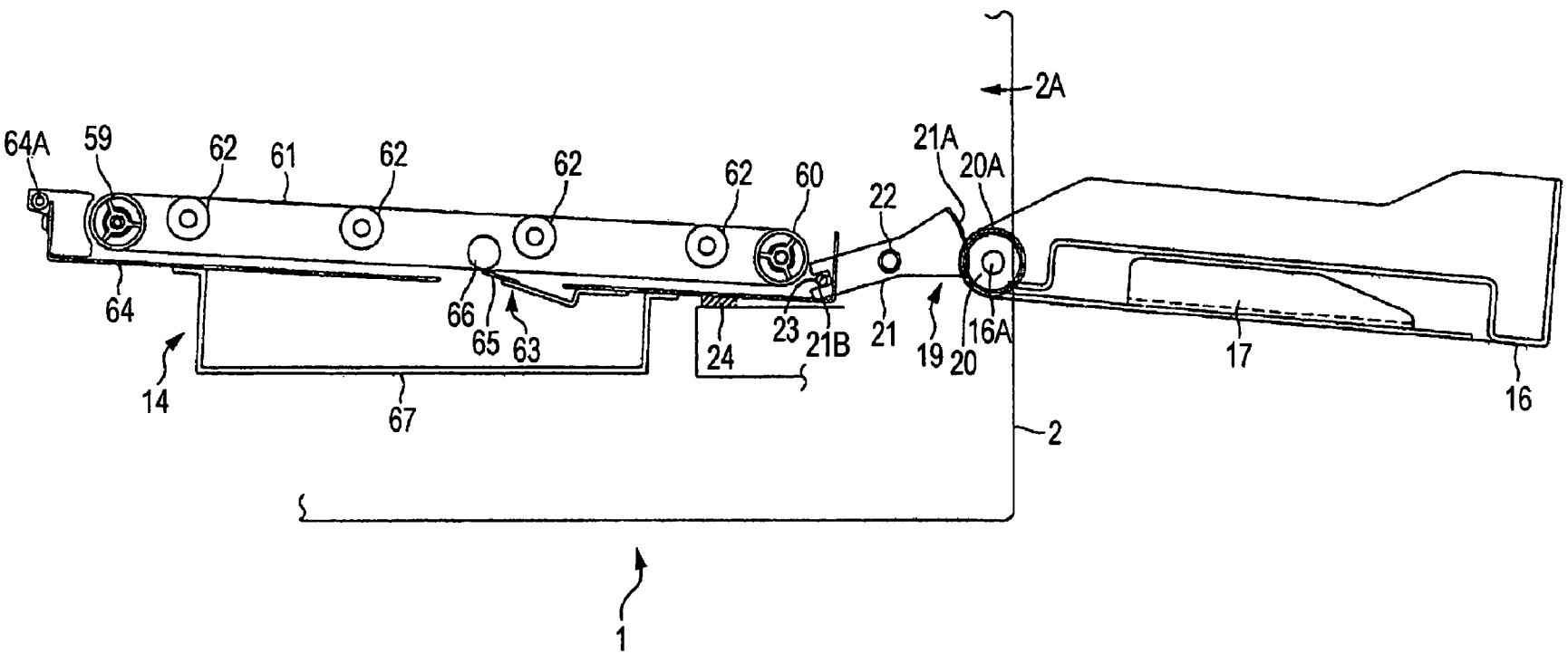
FIG. 4 is a partially sectional side view of the color laser printer showing the constitution of the mechanism of cooperatively moving the cover and the support member showing a state of opening the cover.

FIG. 3 is a partially sectional side view of the color laser printer 1 showing a constitution of a cooperation mechanism 19 for cooperation of the cover 16 and the support member 64 showing a state the cover 16 is open. FIG. 4 is a partially sectional side view of the color laser printer 1 showing the constitution of the cooperation mechanism 19 for cooperation of the cover 16 and the support member 64 showing a state that the cover 16 is open.

As shown in FIG. 3 and FIG. 4, the cover 16 is pivotably attached to the housing 2 about the pivoting shaft 16A. The pivoting shaft 16A extends in the width direction at a lower end portion of the cover 16. The pivoting shaft 16A is connected with the support member 64 by the cooperation mechanism 19. The cooperation mechanism 19 includes a gear 20 and a pivoting member 21 engaging with the gear 20. The gear 20 is provided to the pivoting shaft 16A so that the gear 20 rotates in association with the pivot of the pivoting shaft 16A.

The gear 20 is formed substantially in a circular plate shape and formed with a plurality of teeth 20A over a total of an outer peripheral face thereof.

The pivoting member 21 is formed in a shape elongated in the front-rear direction. A center portion of the pivoting member 21 in its longitudinal direction is pivotably supported by a pivoting shaft 22 extending in the width direction. A portion of the pivoting member 21 on a side of the gear 20 toward the pivoting shaft 22 is formed substantially in a fan shape in a side view so as to expand toward the side of the gear 20. A peripheral face in a circular arc of the fan shape is formed with a plurality of teeth 21A engaging with the teeth 20A of the gear 20.

An end face of the pivoting member 21 on a side opposite to the gear 20 is formed with a recess portion 21B in a shape of being recessed along the longitudinal direction of the pivoting member 21. A pin 23 fixed to a front end portion of the support member 64 is inserted within the recess portion 21B.

As shown in FIG. 3, in association with that the cover 16 is opened in a direction indicated by the arrow mark A in FIG. 3, which is clockwise direction in the drawing, from a state that the cover 16 is closed, the pivoting shaft 16A and the gear 20 are rotated in a direction indicated by an arrow mark D in FIG. 3, which is clockwise direction in the drawing. Then, the pivoting member 21 is pivoted in a direction indicated by an arrow mark E in FIG. 3 which is counterclockwise direction in the drawing about the pivoting shaft 22, thereby, the pin 23 supported within the recess portion 21B moves downwardly. In association with that the pin 23 moves downwardly, the front end portion of the support member 64 moves downwardly. As shown in FIG. 4, in a state that the cover 16 is completely opened, the carrying belt 61 supported by the support member 64 is inclined downwardly from the rear side to the front side.

As shown in FIG. 4, inside of the housing 2 is arranged with a damping member 24. The damping member 24 contacts a lower face of the front end portion of the support member 64 in a state that the cover 16 is completely opened. The damping member 24 is formed of an elastic member of rubber. When the cover 16 is completely opened, the front end portion of the support member 64 can be elastically received by the damping member 24.

<Explanation of Structure of Attaching Supporter>

Figure 5:
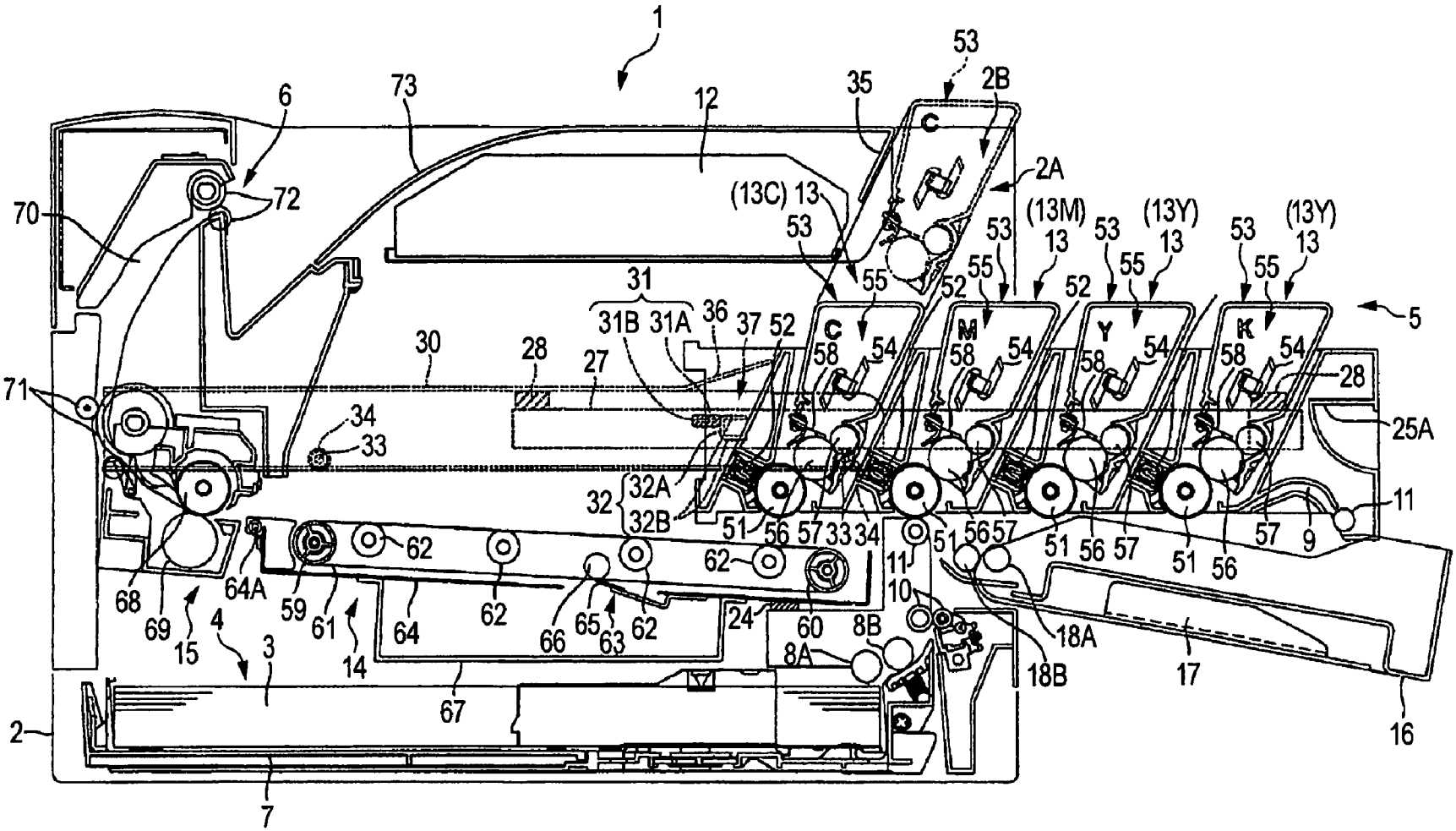
FIG. 5 is a side sectional view showing a state of opening the cover of the color laser printer showing a state of exposing the supporter from inside of the housing.
Figure 6:
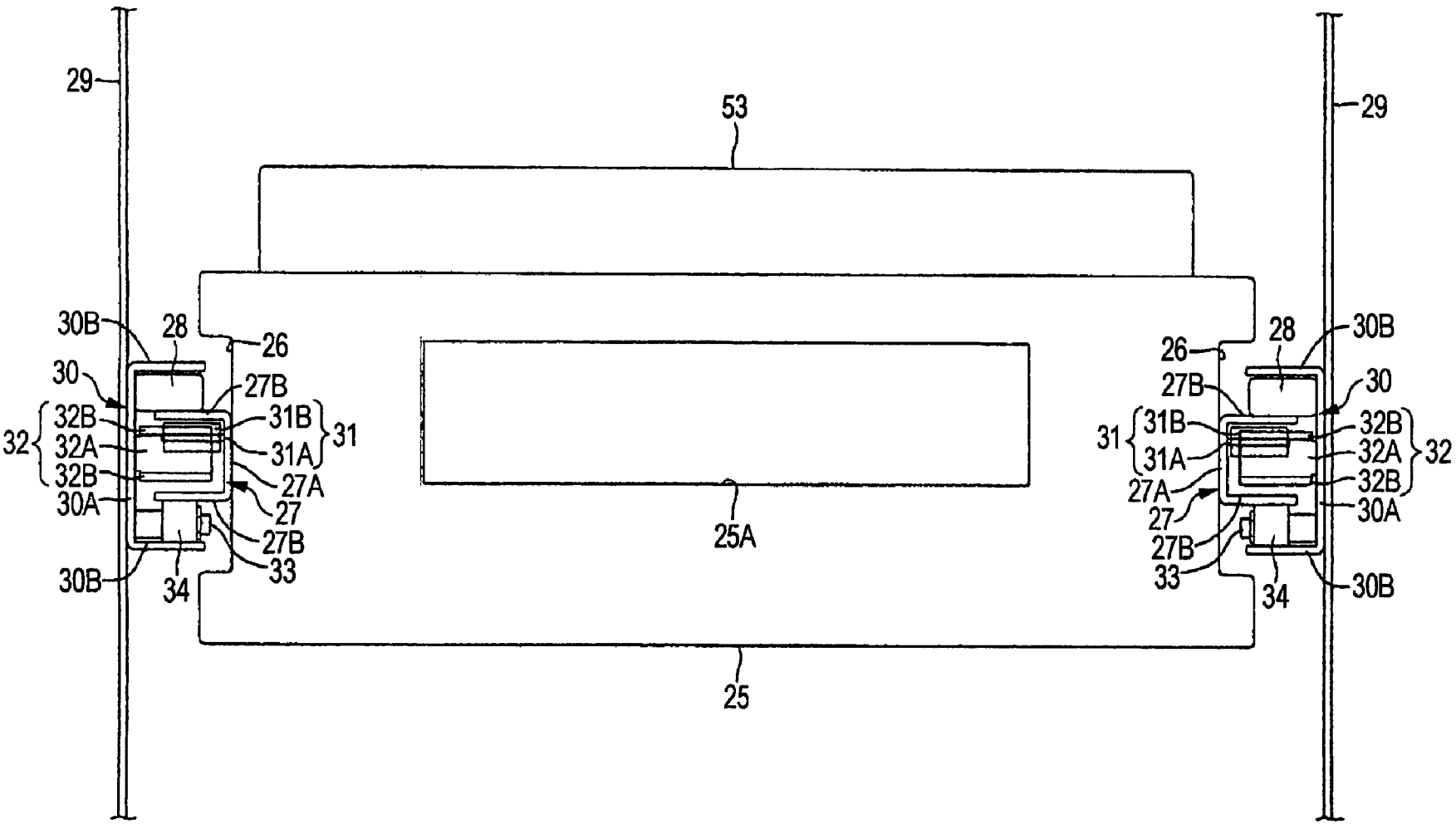
FIG. 6 is a front view showing a constitution of a vicinity of the supporter.

FIG. 5 is a side sectional view showing that the cover 16 is open and the supporter 25 is moved from the housing 2. FIG. 6 is a front view showing a constitution of a vicinity of the supporter 25.

As shown in FIG. 5 and FIG. 6, outer faces on both sides in the width direction of the supporter 25 are formed with recess portions 26 recessed substantially in a rectangular shape to extend in the front-rear direction. A supporter-side guide rail 27 is attached to inside of each of the recess portions 26 and is formed substantially in a channel-like shape to extend in the front-rear direction.

A front end portion of the supporter-side guide rail 27 is disposed at a front end portion of the supporter 25. A rear end portion of the supporter-side guide rail 27 is projected rearwardly from the supporter 25. Each supporter-side guide rail 27 is integrally formed with an attaching plate portion 27A and a pair of side plate portions 27B. The attaching plate portion 27A is formed in a plate-like shape, and is attached to a bottom face of the recess portion 26 along the front-rear direction. Each of the pair of side plate portions 27B is formed in a plate-like shape extending from both upper and lower end edges of the attaching plate portion 27A to outer sides in the width direction.

A front end portion and a rear end portion of an upper face of an upper one of the pair of side plate portion 27B are respectively attached with a pair of restricting blocks 28 for restricting movement of the supporter 25 in the width direction.

An upper rear side of an outer face in the width direction of the attaching plate portion 27A is formed with a supporter-side restricting portion 31 as restricting unit to project toward outside of the supporter 25 in the width direction. The supporter-side restricting portion 31 includes a projected plate 31A and an elastic member 31B.

The projected plate 31A formed in a plate-like shape projects toward outside of the supporter 25 in the width direction from the upper rear side of the outer face in the width direction of the attaching plate portion 27A. The projected plate 31A also extends in the horizontal direction. The elastic member 31B formed in a ring-like shape covers an outer periphery of the projected plate 31A.

A pair of main frames 29, each opposed to the outer faces of the supporter 25 on the both sides in the width direction, are provided inside of the housing 2. A main-side guide rail 30 is attached to each main frame 29.

The main-side guide rail 30 is formed substantially in a channel-like shape at a position opposite to the supporter-side guide rail 27. A front end portion of the main-side guide rail 30 is disposed at the front end portion of inside of the housing 2. The rear end portion of the main side guide rail 30 is disposed at the rear end portion of inside of the housing 2.

Each main-side guide rail 30 is integrally formed with an attaching plate portion 30A and a pair of side plate portions 30B. The attaching plate portion 30A formed in a plate-like shape is attached to an inner face in the width direction of the main frame 29 along the front-rear direction. Each of the pair side plate portions 30B formed in a plate-like shape extends toward inside of the housing 2 in the width direction from both upper and lower end edges of the attaching plate portions 30A.

A front side at a middle portion in the up-down direction of the inner face of the attaching plate portion 30A is formed with a main-side restricting portion 32. The main-side restricting portion 32 is formed substantially in a channel-like shape as restricting unit so as to project toward inside of the housing 2 in the width direction.

The main-side restricting portion 32 is integrally formed with a projected plate portion 32A and a pair of side plate portions 32B. The projected plate portion 32A formed in a plate-like shape projects from the front side of the middle portion in the up-down direction of the inner face of the attaching plate portion 30A toward inside of the housing 2. The projected plate portion 32A further extends in a vertical direction.

Each of the pair of side plate portions 32B formed in a plate-like shape extends toward the front side from both upper and lower end edges, respectively, of the projected plate portion 32A.

A rotation shaft 33 is formed to project from each a front side and a rear side of a lower portion of the inner face in the width direction of the attaching plate portion 30A toward inside of the housing 2 in the width direction. At an inner end portion in the width direction of the rotation shaft 33, a roller 34 is rotatably supported about the rotation shaft 33.

When the supporter 25 is attached to the housing 2, the pair of side plate portions 27B on both sides of the supporter 25 are brought to between the pair of side plate portions 30B on both sides of the supporter 25, thereby, the pair of side plate portions 27B overlap the side plate portions 30B in a plane view.

Thus, a peripheral face of the roller 34 contacts the lower face of the pair of side plate portions 27B, thereby, the supporter-side guide rail 27 is supported on the roller 34.

An upper face of the restriction block 28 is oppositely brought into contact with the lower face of the upper one of the pair of side plate portion 30B. An outer face of the restriction block 28 in the width direction is oppositely brought into contact with an inner face in the width direction of the attaching plate portion 30A. Thereby, the supporter-side guide rail 27 is mounted to the main-side guide rail 30 without play in both the width direction and the up-down direction. Each supporter-side restricting portion 31 is opposed to the rear side of the projected plate portion 32A of the corresponding main-side restricting portion 32.

When the grabbing portion 25A is grabbed and pulled to the front side from a state in which the supporter 25 is inside the housing 2 as shown in FIG. 2, the supporter-side guide rail 27 on both sides of the supporter 25 moves toward the front side relative to the main-side guide rails 30, and the roller 34 contacting the lower face of the lower one of the pair of side plate portions 27B rotates, thereby, the supporter 25 is smoothly moved toward the front side.

At this occasion, movement of the supporter 25 in the width direction is hampered because the restricting blocks 28 contacts the attaching plate portion 30A. The supporter 25 can be stably moved toward the front side.

The supporter 25 moved toward the front side may be exposed to outside of the housing 2 through the front face opening 2A of the housing 2. Further, when the supporter 25 is moved to outside of the housing 2 shown in FIG. 5, the elastic member 31B of the supporter-side restricting portion 31 contacts the projected plate portions 32A from the rear side, therefore, further movement of the supporter 25 toward the front side is restricted. When the elastic member 31B contacts the projected plate portions 32A, the further movement of the supporter 25 is restricted and some impact may occur, however, the elastic member 31B can restrain the impact due to its elasticity.

<Explanation of Attaching and Detaching Developing Apparatus>

As shown in FIG. 2, the developing cartridge 53 of the black process portion 13K at the most downstream side in the direction of moving the supporter 25 is below the upper opening 2B of the housing 2 when the supporter 25 is inside the housing 2. Therefore, even when the supporter 25 is inside the housing 2, as shown by the broken line in FIG. 2, the developing cartridge 53 of the black process portion 13K can be attached to and detached from the supporter 25 through the upper opening 2B.

When the supporter 25 is moved from the housing 2 and the supporter-side restricting portions 31 and the main-side restricting portions 32 are brought into contact with each other as shown in FIG. 5, the developing cartridge 53 of the cyan process portion 13C on the most upstream side in the direction of moving the supporter 25 is at a position where the developing cartridge 53 of the black process portion 13K is in the state shown in FIG. 2. Therefore, because the developing cartridge 53 of the cyan process portion 13C is below the upper opening 2B of the housing 2, the developing cartridge 53 of the cyan process portion 13C can be attached to and detached from the supporter 25 through the upper opening 2B as shown by a broken line in FIG. 5.

In the state shown in FIG. 5, the developing cartridges 53 other than the developing cartridge 53 of the cyan process portion 13C, that is, the respective developing cartridges 53 of the magenta process portion 13M, the yellow process portion 13Y and the black process portion 13K can be attached to and detached from the supporter 25 upwardly.

As shown by the broken lines in FIG. 2 and FIG. 5, the developing cartridge 53 of the black process portion 13K and the developing cartridge 53 of the cyan process portion 13C are guided by the guide portion 35 through the upper opening 2B when the developer cartridges 53 are attached to and detached from the supporter 25.

<Explanation of Attaching and Detaching Supporter>

As shown in FIG. 5, a front end portion of the upper one of the pair of side plate portions 30B is formed with a passing portion 36 by folding to bend the upper one of the pair of side plate portion 30B in a second direction to be inclined upwardly toward the front side. At a vicinity of the main-side restricting portion 32, a rear end of the passing portion 36 is positioned above an upper rear side of the main-side restricting portion 32. The passing portion 36 extends to be remote from the main-side restricting portion 32 as proceeding toward a front end of the passing portion 36. The front end of the passing portion 36 is positioned above an upper front side of the main-side restricting portion 32.

Thereby, a space 37 is formed between the passing portion 36 and the main-side restricting portion 32 so that the supporter-side restricting portion 31 may pass through the space.

In a state in which the supporter 25 is moved from the housing 2 and the supporter-side restricting portion 31 and the main-side restricting portion 32 are brought into contact with each other as shown in FIG. 5, if a user lifts the supporter 25 upwardly and pulls the supporter 25 toward the front side, by moving the supporter-side restricting portion 31 toward the front side so that the supporter-side restricting portion 31 rides over the main-side restricting portion 32, the supporter-side restricting portion 31 separates from the main-side restricting portion 32 and the supporter 25 can be moved toward the front side. Further, the supporter 25 can be detached from the housing 2 by the supporter side restricting portion 31 passing through the space 37.

In order that the supporter 25 is attached to the housing 2, the supporter-side restricting portion 31 may be moved toward the rear side of the main-side restricting portion 32 by moving the supporter 25 to inside of the housing 2 from the front side to the rear side and by passing the supporter-side restricting portion 31 through the space 37 formed between the passing portion 36 and the main-side restricting portion 32.

Figure 7A:
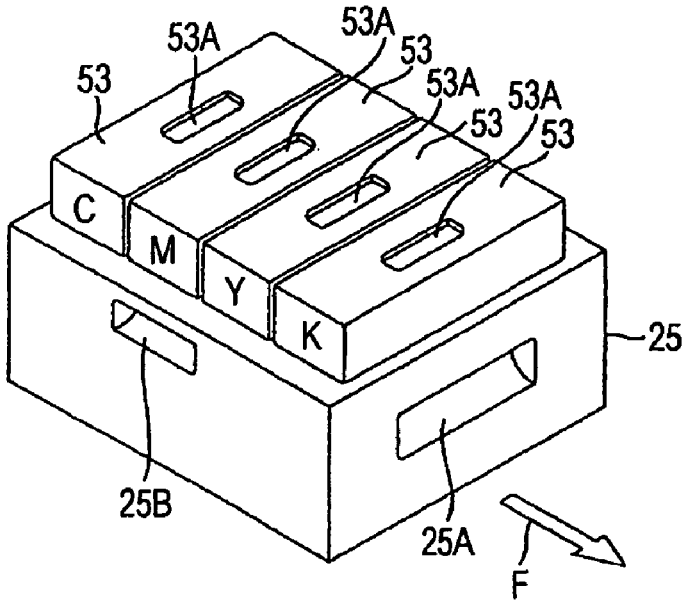
FIGS. 7A, 7B are perspective views of the supporter.
Figure 7B:
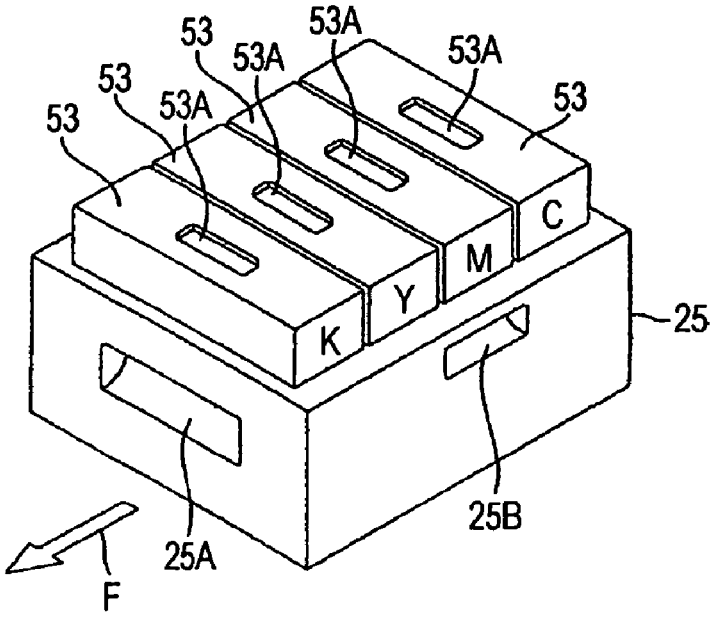

FIGS. 7A and 7B are perspective views of the supporter 25. FIG. 7A shows the supporter 25 from an upper front side on one side in the width direction. FIG. 7B shows the supporter 25 from an upper front side on other side in the width direction. However, in FIGS. 7A, 7B, an outlook of the supporter 25 is simply shown by omitting the recess portion 26, the supporter side guide rail 27 and some of other elements.

As shown in FIGS. 7A and 7B, upper portions on both side faces in the width direction of the supporter 25 are formed with lateral grabbing portions 25B so that a user may grab the lateral grabbing portions 25B to lift the supporter 25 at a center portion in a direction of an arrow mark F of moving the supporter 25 as shown in the drawing.

When the supporter 25 is detached from the housing 2, the supporter 25 can be lifted up by grabbing the two lateral grabbing portions 25B with the user's both hands, or by grabbing one of the two lateral grabbing portions 25B and the front grabbing portion 25A with the user's both hands.

According to the illustrative aspect, as shown in FIG. 5, when the supporter 25 is moved to where only the developing cartridge 53 of the cyan process portion 13C is positioned inside the housing 2, movement of the supporter 25 is restricted. Therefore, in comparison with that the supporter 25 is moved to where all of the developing cartridges 53 are positioned outside the housing 2, the shift of the gravitational center of the color laser printer 1 in the direction of moving the supporter 25 is small and the color laser printer 1 is difficult to be inclined or toppled.

However, in a state of restricting movement of the supporter 25, a number of the developing cartridge 53 positioned inside the housing 2 is not limited to one. Two or more of the developing cartridges 53 may be positioned inside the housing 2 when the movement of the supporter 25 is restricted.

According to the illustrative aspect, the supporter 25 moves for a distance between the developing cartridge 53 of the cyan process portion 13C and the developing cartridge 53 of the black process portion 13K in the state of the supporter 25 is inside the housing 2, until the movement of the supporter 25 is restricted by bringing the supporter-side restricting portions 31 and the main-side restricting portions 32 into contact with each other. Therefore, an amount of the movement of the supporter 25 is small.

Therefore, the shift of the gravitational center of the color laser printer 1 in the direction of movement of the supporter 25 is smaller and the color laser printer 1 is further difficult to be inclined or toppled.

Further, according to the illustrative aspect, movement of the supporter 25 is firmly restricted by bringing the main-side restricting portions 32 and the supporter-side restricting portions 31 into contact with each other.

Further, when the supporter 25 is released from the restriction of movement, the supporter-side restricting portions 31 are permitted to pass over the main-side restricting portions 32 due to the passing portions 36 formed at the main-side guide rails 30. Therefore, restriction of movement of the supporter 25 can be easily released.

Further, as shown in FIG. 5, by lifting up the supporter 25 at the position of the contact of the supporter-side restricting portions 31 with the main-side restricting portions 32, the restriction of the movement of the supporter 25 can be easily released so that the supporter 25 can be detached from the housing. In the above illustrative aspect, the supporter 25 can be detached by lifting the supporter 25 upwardly in the direction orthogonal to the direction of the movement of the supporter 25. Therefore, even if an external force is applied during the detachment of the supporter 25, the shift of the gravitational center of the color laser printer 1 in the direction of the movement of the supporter 25 becomes small, and the color laser printer 1 can be prevented from being inclined or toppled.

Further, when a user lifts up the supporter 25, by grabbing the front grabbing portion 25A or the lateral grabbing portion 25B, the supporter 25 can easily be detached from the housing 2. Because the lateral grabbing portion 25B is formed at the center portion of the supporter 25 in the direction of the movement of the supporter 25, the supporter 25 can be stably lifted up, therefore, the color laser printer 1 can be effectively prevented from being inclined or toppled due to an external force applied during the detachment of the supporter 25.

As shown in FIG. 5, in the state that the supporter 25 is pulled until the supporter-side restricting portions 31 contact the main-side restricting portions 32, the developing cartridge 53 of the cyan process portion 13C arranged on the most upstream side in the direction of the movement of the supporter 25 can easily be attached to and detached from the supporter 25 through the upper face opening 2B of the housing 2.

Further, the housing 2 is formed such that the upper face opening 2B is continuous to the front face opening 2A. Therefore, there exists an enough clearance through a combination of the upper face opening 2B and the front face opening 2A that the developing cartridge 53 can be further easily attached to and detached from the housing 2.

Further, because the front face opening 2A and the upper face opening 2B can be opened and closed with the cover 16, it can be prevented that dust is introduced inside the housing 2 from the front face opening 2A and the upper face opening 2B, and it is also prevented to effect an adverse influence on forming the image carried out at a vicinity of the developing cartridge 53.

Further, as shown in FIG. 2, when the cover 16 is opened, even when the supporter 25 is not pulled, the developing cartridge 53 of the black process portion 13K disposed on the most downstream side in the direction of the movement of the supporter 25 can be handily attached to and detached from the supporter 25 through the upper face opening 2B of the housing 2. Therefore, in comparison with that even a single developing cartridge 53 cannot be attached to or detached from the supporter 25 unless the supporter 25 is completely moved from the housing 2, it is excellent to manage the replacement of the developing cartridge 53.

According to the illustrative aspect, the developing cartridge 53 of the black process portion 13K accommodating a large amount of toner is capable of being attached to and detached from the supporter 25 through the upper face opening 2B while the supporter 25 is inside the housing 2. Therefore, the developing cartridge 53 of the black process portion 13K can be replaced frequently and handily. It is further excellent to manage the replacement of the developing cartridge 53 of the black toner.

As shown in FIG. 2 and FIG. 5, while attachment and detachment of the developer cartridge 53, the developing cartridge 53 is guided by the guide portion 35. Therefore, the developing cartridges 53 can be smoothly attached to and detached from the supporter 25.

Further, according to the illustrative aspect, the direction of the movement of the supporter 25 is substantially same as the direction of the movement of the sheet cassette 7. Therefore, it should be easier to operate the color laser printer 1.

Further, because the carrying belt 61 is displaced in the direction of being remote from the photosensitive drum 51 in corporation with opening the cover 16, the photosensitive drum 51 may not rub against the carrying belt 61 while the supporter 25 moves relative to the housing 2. Therefore, it can be prevented that the photosensitive drum 51 is damaged.

According to the illustrative aspect, the supporter 25 is pulled toward a side opposite from the side where the fixing portion 15 is provided. Therefore, the shift of the gravitational center of the color laser printer 1 in the direction of the movement of the supporter 25 is smaller and it is further difficult that the color laser printer 1 is inclined or toppled.

According to the illustrative aspect, in attaching and detaching the developing apparatus, when the supporter is moved from inside of the housing to the side of being exposed, the supporter is restricted from being moved by the restricting unit in a state in which the at least one developing apparatus of the plurality of developing apparatus supported by the supporter is disposed at inside of the housing. Therefore, in comparison with a constitution of moving the supporter until all of the plurality of developing apparatus are exposed to outside of the housing, a shift of a gravitational center of the image forming apparatus in a direction of moving the supporter is small, the image forming apparatus is difficult to be inclined or toppled.

According to the illustrative aspect, the supporter is movable in a first direction from a first position where the supporter is inside the housing to a second position where the restricting unit restricts the movement of the supporter. The plurality of developing apparatus are arranged along the first direction. The at least one developing apparatus is positioned at an upstream part in the supporter in the first direction when the supporter is in the first position. When the supporter is in the second position, the at least one developing apparatus is positioned where one of the plurality of developing apparatus at a downstream part in the supporter is when the supporter is in the second position.

Even in a state in which the at least one developing apparatus is disposed at inside of the housing, when the gravitational center of the image forming apparatus in the direction of moving the supporter is significantly shifted by a position thereof, the image forming apparatus is liable to be inclined or toppled.

According to the illustrative aspect, when the supporter is moved from inside of the housing to the side of being exposed, the supporter is restricted from being moved by the restricting unit when the developing apparatus arranged on the most upstream side in the direction of moving the supporter is moved to the position at which the developing apparatus on the most downstream side in the moving direction has been arranged in the state of containing the supporter at inside of the housing and therefore, an amount of moving the supporter is small. Therefore, the shift of the gravitational center of the image forming apparatus in the direction of moving the supporter is smaller and the image forming apparatus is further difficult to be inclined or toppled.

According to the illustrative aspect, the restricting unit comprises: a main-side restricting portion provided in the housing; and a supporter-side restricting portion provided in the supporter. The supporter-side restricting portion is brought into contact with the main-side restricting portion when the supporter is in the second position.

According to the constitution, by bringing the main-side restricting portion provided at the housing and the supporter-side restricting portion provided in the supporter into contact with each other in accordance with moving the supporter, the supporter is firmly restricted from being moved.

According to the illustrative aspect, the housing comprises a rail extending along the first direction. The rail movably supports the supporter. The rail is formed with a passing portion at a vicinity of the main-side restricting portion. The passing portion extends in a second direction of being inclined with respect to the first direction to define a space between the passing portion and the main-side restricting portion such that the supporter-side restricting portion passes the space.

According to the constitution, when the supporter is released from being restricted by the restricting unit, by the passing portion formed at the rail, the supporter-side restricting portion is permitted to pass through the main-side restricting portion and therefore, the supporter can easily be released from being restricted by the restricting unit.

According to the illustrative aspect, the supporter is released from being restricted by the restricting unit when the supporter is lifted up at a position where the movement of the supporter is restricted by the restricting unit.

According to the constitution, the supporter can be detached from the housing by easily releasing the supporter from being restricted by the restricting unit by lifting the supporter to the upper side at the position of restricting the supporter from being moved by the restricting unit. In a case of a constitution in which the supporter is moved in a horizontal direction, the supporter is detached by being lifted in a direction orthogonal to the moving direction (upper side) and therefore, the shift of the gravitational center of the image forming apparatus in the direction of moving the supporter by an external force exerted in detaching the supporter becomes small and the image forming apparatus can be prevented from being inclined or toppled.

According to the illustrative aspect, the supporter is formed with a grabbing portion at a center portion of the supporter in the first direction. The grabbing portion is grabbed by a user when the user lifts the supporter up.

According to the constitution, by lifting the supporter by grabbing the grabbing portion, the supporter can easily be detached. The grabbing portion is formed at the center portion in the direction of moving the supporter and therefore, the supporter can stably be lifted and the image forming apparatus can effectively be prevented from being inclined or toppled by the external force exerted in detaching the supporter.

According to the illustrative aspect, the housing further includes: a front face; and an upper face. The front face is formed with a front face opening. The upper face is formed with an upper face opening. The front face is continuous to the upper face opening. The housing further may includes: a cover attached to the front face. The cover is configured to be opened. The front face opening and upper face opening are opened and closed with the cover.

According to the constitution, in a state in which the at least one developing apparatus is disposed at inside of the housing by restricting the supporter from being moved by the restricting unit, the at least one developing apparatus can easily be attached and detached by passing the upper face opening.

Further, the upper face opening is continuous to the front face opening and therefore, in attaching and detaching the developing apparatus by passing the upper face opening, the developing apparatus can be attached and detached by the upper face opening with a spatial allowance by the front face opening and therefore, the developing apparatus can further easily be attached and detached.

Further, the front face opening and the upper face opening can be opened and closed by the cover and therefore, it can be prevented that dust or dirt invades inside of the housing from the front face opening and the upper face opening to effect an adverse influence on forming the image carried out at a vicinity of the developing apparatus.

According to the illustrative aspect, when the cover is opened, another one of the plurality of developing apparatus different from the at least one developing cartridge is attachable to and detachable from the supporter through the upper face opening even if the supporter is inside the housing.

According to the constitution, when the cover is opened, the developing apparatus different from the developing apparatus which can be attached and detached when the supporter is moved from the housing (the at least one developing apparatus) can handily be attached and detached by the upper face opening even when the supporter is not moved from inside of the housing. Therefore, in comparison with the constitution in which even a single one of the developing apparatus cannot be attached and detached unless the supporter is moved from inside of the housing, a way of use is excellent.

In a state of containing the supporter at inside of the housing, when the developing apparatus by which an amount of consuming a developing agent is large (for example, the developing apparatus including a developing agent of black) is constituted to be able to be attached and detached by passing the upper face opening, the developing apparatus can frequently be interchanged by handily attaching and detaching the developing apparatus by way of the upper face opening and therefore, the way of use is further excellent.

According to the illustrative aspect, the housing is formed with a guide portion extending toward the upper face opening. The developing apparatus is guided by the guide portion when the developing apparatus passes through the upper face opening.

According to the constitution, the developing apparatus attached and detached by passing the upper face opening can be guided by the guide portion along the direction of passing the developing apparatus through the upper face opening and therefore, the developing apparatus can smoothly be attached and detached.

According to the illustrative aspect, the image forming apparatus comprises a housing; a supporter located in the housing; and a plurality of developing apparatus attachable to and detachable from the supporter. The supporter is movable relative to the housing. The housing further includes: a front face; an upper face; and a cover attached to the front face. The front face is formed with a front face opening. The upper face is formed with an upper face opening. The front face is continuous to the upper face opening. The cover is configured to be opened. The front face opening and upper face opening are opened and closed with the cover. When the cover is opened, at least one of the developing apparatuses is attachable to and detachable from the supporter through the upper face opening even if the supporter is inside the housing.

According to the constitution, when the cover is opened, the at least one developing apparatus of the plurality of developing apparatus can handily be attached and detached by way of the upper face opening even when the supporter is not moved from inside of the housing. Therefore, in comparison with a constitution in which even a single one of the developing apparatus cannot be attached and detached unless the supporter is moved from inside of the housing, the way of use is excellent.

In a state of containing the supporter at inside of the housing, when the developing apparatus by which an amount of consuming a developing agent is large (for example, the developing apparatus containing a developing agent of black) is constituted to be able to attached and detached by passing the upper face opening, the developing apparatus can frequently be interchanged by handily attaching and detaching the developing apparatus by way of the upper face opening and therefore, the way of use is further excellent.

Further, the upper opening is continuous to the front face opening and therefore, when the developing apparatus is attached and detached by passing the upper face opening, the developing apparatus can be attached and detached by way of the upper face opening with a spatial allowance by the front face opening and therefore, the developing apparatus can further easily be attached and detached.

Further, the front face opening and the upper face opening can be opened and closed by the cover and therefore, it can be prevented that dust or dirt invades inside of the housing from the front face opening and the upper face opening to effect an adverse influence on forming the image carried out at a vicinity of the developing apparatus.

According to the illustrative aspect, the supporter is movable in a first direction from a first position where the supporter is inside the housing to where the supporter is outside the housing. The developing apparatuses are arranged along the first direction. The image forming apparatus further comprises: a restricting unit that restricts movement of the supporter. When the supporter is in the first position, one of the developing apparatuses is positioned at an upstream end in the supporter and another one of the plurality of developing apparatuses is positioned at downstream end in the supporter in the first direction. The movement of the restriction is restricted when the one of the developing apparatuses is positioned where another one of the developing apparatuses is.

According to the constitution, in attaching and detaching the developing apparatus, when the supporter is moved from inside of the housing to the side of being disposed, the supporter is restricted from being moved by the restricting unit in a state in which at least the developing apparatus of the plurality of developing apparatus supported by the supporter arranged on the most upstream side in the direction of moving the supporter is disposed at inside of the housing. Therefore, in comparison with the constitution in which the supporter is moved until all of the plurality of developing apparatus are exposed to outside of the housing, the shift of the gravitational center of the image forming apparatus in the direction of moving the supporter is small and the image forming apparatus is difficult to be inclined or toppled.

According to the illustrative aspect, the supporter is movable to a second position where the restricting unit restricts the movement of the supporter. The one of the plurality of developing apparatuses is attachable to and detachable from the supporter through the upper face opening when the supporter is at the second position.

According to the constitution, in a state of moving the supporter until the supporter is restricted by the restricting unit, the developing apparatus arranged on the most upstream side in the direction of moving the supporter is moved to the position at which the developing apparatus on the most downstream side in the moving direction has been arranged in the state of containing the supporter at inside of the housing and the developing apparatus arranged on the most upstream side in the direction of moving the supporter can easily be attached and detached by way of the upper face opening.

According to the illustrative aspect, the image forming apparatus further comprises: an image carrier capable of carrying a developing agent stored in the developing apparatus. The supporter is movable along a direction orthogonal to a longitudinal direction of the image carrier.

The developing agent carried by the image carrier is transcribed onto a record medium carried to the image carrier, at this occasion, the record medium is carried in a direction orthogonal to a longitudinal direction of the image carrier. A record medium containing portion for containing the record medium is arranged to the housing movably in a direction of carrying the record medium (direction orthogonal to the longitudinal direction of the image carrier) and moved from the housing to contain the record medium.

According to the illustrative aspect, the direction of moving the supporter and the direction of moving the record medium containing portion can be constituted by the same direction and therefore, in comparison with the constitution in which the directions differ from each other, operability of the image forming apparatus can be promoted.

According to the illustrative aspect, the image forming apparatus further comprises: a belt arranged to be opposed to the image carrier; and a cooperation mechanism that displaces the belt in a direction remote from the image carrier in cooperation with that the cover is opened. The belt is driven for carrying a record medium between the belt and the image carrier.

According to the constitution, in cooperation with the opening the cover, the belt is displaced in a direction of being remote from the image carrier and therefore, when the supporter is moved relative to the housing, it can be prevented that the belt and the image carrier rub each other to damage the image carrier.

According to the illustrative aspect, the image forming apparatus further comprises: a carrying path formed inside the housing on which the record medium is carried along a direction of the movement of the supporter. The supporter is capable to move toward upstream of the direction in which the record medium is carried on the carrying path.

A down stream side in the direction of carrying the record medium of the carrying path is arranged with a fixing portion for subjecting the record medium transcribed with the developing agent by the image carrier to a fixing processing.

According to the illustrative aspect, the supporter is moved to a side opposed to a side of arranging the fixing portion. Therefore, the supporter can be moved by being separated from the fixing portion and therefore, the shift of the gravitational center of the image forming apparatus in the direction of moving the supporter is smaller and the image forming apparatus is further difficult to be inclined or toppled.

According to the illustrative aspect, the shift of the gravitational center of the image forming apparatus is small and the image forming apparatus is difficult to be inclined or toppled.

According to the illustrative aspect, the shift of the gravitational center of the image forming apparatus in the direction of moving the supporter is smaller and the image forming apparatus is further difficult to be inclined or toppled.

According to the illustrative aspect, the supporter is firmly restricted from being moved.

According to the illustrative aspect, the supporter can easily be released from being restricted by the restricting unit.

According to the illustrative aspect, the shift of the gravitational center of the image forming apparatus in the direction of moving the supporter by the external force exerted in detaching the supporter becomes small and the image forming apparatus can be prevented from being inclined or toppled.

According to the illustrative aspect, the supporter can stably be lifted to the upper side and it can be effectively prevented that the image forming apparatus is inclined or toppled by the external force exerted in detaching the supporter.

According to the illustrative aspect, the at least one developing apparatus can easily be attached and detached by passing the upper face opening. Further, the developing apparatus can be attached and detached by way of the upper face opening with the spatial allowance by the front face opening and therefore, the developing apparatus can further easily be attached and detached. Further, it can be prevented that dust or dirt invades inside of the housing from the front face opening and the upper face opening to cause an adverse influence on forming the image carried out at a vicinity of the developing apparatus.

According to the illustrative aspect, in comparison with the constitution in which even a single one of the developing apparatus cannot be attached and detached unless the supporter is moved from inside of the housing, the way of use is excellent.

According to the illustrative aspect, the developing apparatus can smoothly be attached and detached.

According to the illustrative aspect, in comparison with the constitution in which even the single one of the developing apparatus cannot be attached and detached unless the supporter is moved from inside of the housing, the way of use is excellent. Further, the developing apparatus can be attached and detached by way of the upper face opening with the spatial allowance by the front face opening and therefore, the developing apparatus can further easily be attached and detached. Further, it can be prevented that dust or dirt invades inside of the housing from the front face opening and the upper face opening to cause an adverse influence on forming the image carried out at a vicinity of the developing apparatus.

According to the illustrative aspect, the shift of the gravitational center of the image forming apparatus in the direction of moving the supporter is small and the image forming apparatus is difficult to be inclined or toppled.

According to the illustrative aspect, the developing apparatus arranged on the most upstream side in the direction of moving the supporter can easily be attached and detached by way of the upper face opening.

According to the illustrative aspect, operability of the image forming apparatus can be promoted.

According to the illustrative aspect, when the supporter is moved relative to the housing, it can be prevented that the image carrier is damaged by rubbing the belt and the image carrier.

According to the illustrative aspect, the shift of the gravitational center of the image forming apparatus in the direction of moving the supporter is smaller and the image forming apparatus is further difficult to be inclined or toppled.

What is claimed is:

1. An image forming apparatus comprising:

a housing;

a supporter located in the housing, the supporter being movable relative to the housing;

a plurality of developing apparatuses attachable to and detachable from the supporter; and a restricting unit that restricts movement of the supporter in a first direction while at least one developing apparatus supported by the supporter is inside the housing, wherein the supporter is movable in the first direction from a first position where the supporter is inside the housing to a second position where a portion of the supporter is inside the housing, a portion of the supporter is outside the housing and the restricting unit restricts the movement of the supporter in the first direction; wherein the plurality of developing apparatuses are arranged along the first direction, the at least one developing apparatus is positioned at an upstream part in the supporter in the first direction when the supporter is in the first position, and when the supporter is in the second position, the at least one developing apparatus is positioned where one of the plurality of developing apparatuses at a downstream part in the supporter is positioned when the supporter is in the first position.

2. The image forming apparatus according to claim 1, wherein in the first position, the supporter is installed in the housing.

3. The image forming apparatus according to claim 1, wherein the restricting unit comprises:

a main-side restricting portion provided in the housing; and a supporter-side restricting portion provided in the supporter, wherein the supporter-side restricting portion is brought into contact with the main-side restricting portion when the supporter is in the second position.

4. The image forming apparatus according to claim 3, wherein the housing comprises a rail extending along the first direction, the rail movably supporting the supporter, and wherein the rail is formed with a passing portion at a vicinity of the main-side restricting portion, the passing portion extending in a second direction inclined with respect to the first direction to define a space between the passing portion and the main-side restricting portion such that the supporter-side restricting portion passes the space.

5. The image forming apparatus according to claim 1, wherein the supporter is released from being restricted by the restricting unit when the supporter is lifted up at a position where the movement of the supporter is restricted by the restricting unit.

6. The image forming apparatus according to claim 5, wherein the supporter is formed with a grabbing portion at a center portion of the supporter in the first direction, the grabbing portion configured to be grabbed by a user when the user lifts the supporter up.

7. The image forming apparatus according to claim 1, wherein the housing further includes:

a front face; and an upper face, wherein the front face is formed with a front face opening, and the upper face is formed with an upper face opening, the front face being continuous to the upper face opening.

8. The image forming apparatus according to claim 7, wherein the housing further includes:

a cover attached to the front face, the cover being configured to be opened, the front face opening and the upper face opening being opened and closed with the cover.

9. The image forming apparatus according to claim 8, wherein when the cover is opened, another one of the plurality of developing apparatuses different from the at least one developing apparatus is attachable to and detachable from the supporter through the upper face opening without the supporter being moved in a direction of withdrawal.

10. The image forming apparatus according to claim 7, wherein the housing is formed with a guide portion extending toward the upper face opening, the developing apparatuses being guided by the guide portion when the developing apparatuses pass through the upper face opening.

11. The image forming apparatus according to claim 1, further comprising:

an image carrier configured to carry developing agent stored in the developing apparatuses, wherein the supporter is movable along a direction orthogonal to a longitudinal direction of the image carrier.

12. The image forming apparatus according to claim 11, further comprising:

a belt arranged to be opposed to the image carrier, the belt being driven for carrying a record medium between the belt and the image carrier; and a cooperation mechanism that displaces the belt in a direction remote from the image carrier in cooperation with the cover being opened.

13. The image forming apparatus according to claim 1, further comprising:

a carrying path formed inside the housing on which the record medium is carried along a direction of the movement of the supporter;

wherein the supporter is configured to move upstream in the direction in which the record medium is carried on the carrying path.

14. An image forming apparatus comprising:

a housing;

a supporter located in the housing, the supporter being movable relative to the housing; and a plurality of developing apparatuses attachable to and detachable from the supporter, wherein the housing further includes:

a front face;

an upper face, wherein the front face is formed with a front face opening, and the upper face is formed with an upper face opening, the front face being continuous to the upper face opening; and a cover attached to the front face, the cover being configured to be opened, the front face opening and the upper face opening being opened and closed with the cover, wherein, when the cover is opened, at least one of the plurality of developing apparatuses is attachable to and detachable from the supporter through the upper face opening without the supporter being moved in a direction of withdrawal; wherein the supporter is movable in a first direction from a first position where the supporter is inside the housing to where the supporter is outside the housing, and the plurality of developing apparatuses are arranged along the first direction, the image forming apparatus further comprising: a restricting unit that restricts movement of the supporter, wherein when the supporter is in the first position, one of the plurality of developing apparatuses is positioned at an upstream end in the supporter and another one of the plurality of developing apparatuses is positioned at a downstream end in the supporter in the first direction, the movement of the supporter being restricted when the one of the plurality of developing apparatuses is positioned where the another one of the plurality of developing apparatuses is positioned when the supporter is in the first position.

15. The image forming apparatus according to claim 14, further comprising:

a carrying path formed inside the housing on which the record medium is carried along a direction of the movement of the supporter;

wherein the supporter is configured to move upstream in the direction in which the record medium is carried on the carrying path.

16. The image forming apparatus according to claim 14, wherein the supporter is movable to a second position where the restricting unit restricts the movement of the supporter, and the one of the plurality of developing apparatuses is attachable to and detachable from the supporter through the upper face opening when the supporter is at the second position.

17. The image forming apparatus according to claim 14, further comprising:

an image carrier configured to carry developing agent stored in the developing apparatuses, wherein the supporter is movable along a direction orthogonal to a longitudinal direction of the image carrier.

18. The image forming apparatus according to claim 17, further comprising:

a belt arranged to be opposed to the image carrier, the belt being driven for carrying a record medium between the belt and the image carrier; and a cooperation mechanism that displaces the belt in a direction remote from the image carrier in cooperation with the cover being opened.

* * * * *